US009622515B1

(12) United States Patent
Dietz

(10) Patent No.: US 9,622,515 B1
(45) Date of Patent: Apr. 18, 2017

(54) BREAST NEST

(71) Applicant: Pamala Dietz, Blairsville, GA (US)

(72) Inventor: Pamala Dietz, Blairsville, GA (US)

( * ) Notice: Subject to any disclaimer, the term of this patent is extended or adjusted under 35 U.S.C. 154(b) by 0 days.

(21) Appl. No.: 15/052,341

(22) Filed: Feb. 24, 2016

Related U.S. Application Data

(60) Provisional application No. 62/252,815, filed on Nov. 9, 2015.

(51) Int. Cl.
*A41C 3/00* (2006.01)
*A41C 3/08* (2006.01)

(52) U.S. Cl.
CPC ..... *A41C 3/005* (2013.01); *A41C 3/08* (2013.01)

(58) Field of Classification Search
CPC ..... A41C 3/00; A41C 3/0021; A41C 3/144; A41C 3/005; A41D 9/12; A41D 13/0575; A47C 20/02; A47C 20/026
USPC ..... 450/37, 54–57; 2/267, 268; 5/630
See application file for complete search history.

(56) References Cited

U.S. PATENT DOCUMENTS 5,083,555 A * 1/1992 Lewis ..... A45D 44/22 450/69
5,807,160 A * 9/1998 Wehmeyer ..... A41C 3/00 2/1
6,095,894 A * 8/2000 Stevens ..... A41D 13/0575 2/267
6,769,955 B1 * 8/2004 Fisher ..... A41C 3/0035 2/267
7,001,239 B2 * 2/2006 Russell ..... A45D 44/22 2/267
7,144,295 B2 * 12/2006 Fisher ..... A41C 3/005 2/267
8,007,343 B1 * 8/2011 Komsky ..... A41B 9/12 2/268
8,047,892 B1 * 11/2011 Dempsey ..... A41C 3/005 450/54
8,216,023 B2 * 7/2012 Donnelly ..... A41C 3/0021 450/54
2012/0210515 A1 * 8/2012 Kass ..... A47C 20/026 5/630
2013/0036553 A1 * 2/2013 Mann Kass ..... A47C 20/02 5/630
2015/0157062 A1 * 6/2015 Rickauer ..... A41C 3/144 450/57

* cited by examiner

*Primary Examiner* — Gloria Hale
(74) *Attorney, Agent, or Firm* — Berggren, Inc.

(57) ABSTRACT

A female breast support apparatus is disclosed. The present invention discloses a rigid body member with rounded ends and curved sides to be placed between the female breasts to reduce or prevent the occurrence of wrinkles between the breasts due to various reasons, such as breast implants, pregnancy, aging etc., while the female is sleeping sideways.

3 Claims, 1 Drawing Sheet

PRODUCT FIGURES
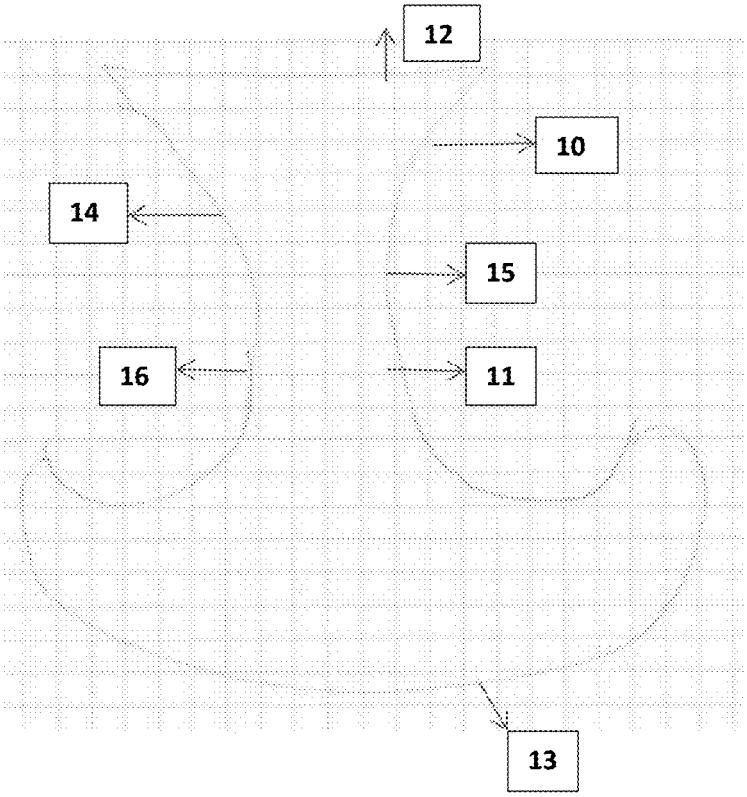

BREAST NEST

CROSS REFERENCE TO RELATED APPLICATION

Not Applicable

FEDERALLY SPONSORED RESEARCH AND DEVELOPMENT

Not Applicable

MICROFICHE APPENDIX

Not Applicable

BACKGROUND OF THE INVENTION (1) Field of the Invention

The present invention generally relates to clothing articles or undergarments, and, more particularly, to an improved bust support apparatus to support the bust while the user sleep sideways to prevent wrinkles.

(2) Background of the Invention

Breast enlargement, due to pregnancy, nursing, breast enlargement surgery, premenstrual symptoms, and the like, may cause discomfort when a woman lies on her side. Additionally, wrinkles tend to develop in the cleavage area between a woman's breasts due to aging, extensive exercising, the aftermath of a pregnancy, and the like. Such wrinkles become visible, and are deemed to be unsightly. It is believed that sleeping without a bra for reasons of comfort also accelerates the appearance of such wrinkles. For example, when a woman lies sideways in a sleeping position, gravity tends to create wrinkles in the cleavage area of the bust. When engaging in athletics, special sports bras force the breasts of a woman closer to the body in order to avoid injury. However, such positioning of the breasts may also exacerbate the formation of wrinkles in the cleavage area. Although the past few years have witnessed the development of therapeutic bolsters and corrective brassieres, there is no known prior art that reduces or prevents wrinkles in human breasts.

Various prior arts have disclosed several bolsters used for conventional and therapeutic purposes. U.S. Pat. No. 5,083,555 A discloses an apparatus that is suitable for reducing and preventing skin deformation in proximity to the breasts of a human female when worn between said breasts. The device includes a shaped, deformable, resilient central support member that has a first end and a second end. U.S. Pat. No. 7,001,239 B2 discloses an anti-wrinkle device is lightweight, rigid, hollow and ergonomically contoured to fit comfortably in the area between the breasts of a human female. The hollow member is designed to prevent wrinkles from occurring in the cleavage area when women are lying on their shoulders and/or sides while sleeping.

U.S. Pat. No. 8,007,343 B1 discloses a bust support device that utilizes a pillow member with a top, bottom, and a pair of curving side portions to permit the pillow to be placed in the cleavage area of the bust. U.S. Pat. No. 8,047,892 B1 discloses an undergarment for wearing about the torso of a woman. The undergarment includes a central spacer of elongate form, which is sized to reside between the breasts and keep them spaced from each other, particularly when the woman is lying down. Another prior art, Patent No US 20130036553 A1, discloses a breast support apparatus comprised of a pillow with an inner core and concave sides; wherein the pillow is shaped to be placed between a user's breasts to provide support to the user's breasts for a user in a horizontal position.

It would be an advance in the art to provide vertical support against the force of gravity on tissues, scars, or sutures. It would also be an advance to provide support against the transfer of pressure into tissues in any direction.

SUMMARY

In view of the foregoing disadvantages inherent in the known types of breast support apparatus or like in the prior art, the present invention provides an improved apparatus. The apparatus is provided as a sleeping accessory for women who have undergone breast-related surgery to reduce discomfort and formation of wrinkles. As such, the general purpose of the present invention, which will be described subsequently in greater detail, is to provide a new and improved breast supporting apparatus to minimize discomfort and hold the breasts in a stable position that has all of the advantages of the prior art, and none of the disadvantages.

Accordingly, it is principal objective of the present invention to provide an apparatus for preventing and reducing the occurrence of wrinkles near female breasts.

The invention relates to an apparatus that is designed to reduce or prevent wrinkles in the area above and between the breasts of women who sleep on their sides. The apparatus is made of expandable memory foam material in a cylindrical, semi-curved shape that is secured in a manner which keeps the breast separated, thereby preventing wrinkles from forming and softening existing wrinkles.

It is an objective of the present invention to provide a comfortable apparatus to reduce wrinkles above and between human breasts, which may be due to multiple reasons, including breast implants, weight loss, aging, or pregnancy.

It is yet another objective of the present invention to provide an apparatus that is simple and easy to use.

There has thus been outlined, rather broadly, the more important features of the invention in order that the detailed description thereof that follows may be better understood, and in order that the present contribution to the art may be better appreciated.

Numerous objectives, features, and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments, and of being practiced and carried out in various ways. Also, it is to be understood that the phraseology and terminology employed herein are for the purpose of description, and should not be regarded as limiting.

BRIEF DESCRIPTION OF THE DRAWINGS

To further clarify various aspects of some example embodiments of the present invention, a more particular description of the invention will be rendered by reference to specific embodiments thereof, which are illustrated in the appended drawing. It is appreciated that the drawing depicts only illustrated embodiments of the invention, and is, therefore, not to be considered limiting of its scope. The invention will be described and explained with additional specificity and detail through the use of the accompanying drawing, in which:

FIG. 1 is perspective view of the present invention.

DETAILED DESCRIPTION OF THE INVENTION

The embodiments of the present disclosure, described below, are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention, and, together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed, and the subject invention is intended to include all such aspects and their equivalents. Other advantages and novel features of the invention will become apparent from the following detailed description of the invention when considered in conjunction with the drawings.

In some preferred embodiments, the present invention provides a novel and useful support device for the breasts that is both comfortable and firmly positioned; wherein the support device of the present invention utilizes a pillow member that has an outer covering that forms a chamber for accommodating filler material within the chamber.

This section summarizes some aspects of the present disclosure and briefly introduces some preferred embodiments. Simplifications or omissions in this section, as well as in the abstract or the title of this description, may be made to avoid obscuring the purpose of this section, the abstract, and the title. Such simplifications or omissions are not intended to limit the scope of the present disclosure, nor imply any limitations.

Referring to the invention now in more detail, the present invention discloses an apparatus 10 that constitutes a main body segment 11 fabricated from rigid material. It has been determined that a rigid material is more effective in preventing wrinkles than any other kind of material employed in the related art. The body segment 11 is a whole one-piece unit with an outer covering. The body segment 11 is ergonomically designed for comfort. The proximate end 12 and distal end 13 are curved and rounded, while the side areas 14, 15 are concave. The rear 16 end of the body segment 11 has a defined configuration, so as to conform to the natural contour of human female garment. As contemplated, the disclosed apparatus 10 will be made in various standard sizes to accommodate different breast sizes.

In use, the disclosed apparatus 10 is disposed in the cleavage area between the breasts of the user. A comfortable clothing article, preferably made of a stretchable material, is worn to comfortably secure the apparatus 10 in its position. The apparatus 10 functions to keep the breasts separated, and to prevent the gravity induced sagging that causes wrinkles to appear.

Accordingly, the present invention provides a novel and useful support apparatus for female breasts that is both comfortable and firmly positioned. The support apparatus of the present invention utilizes a body member with an outer covering forming a chamber for accommodating a filler material within the chamber. The body member includes a top, a pair of curved side portions oriented to curve in opposite orientation from one another, and a bottom. The top, side portions, and bottom form the perimeter of the pillow such that a part of each of the side portions underlies each of the breasts of the subject when in use.

In a preferred embodiment, the present invention provides a breast support apparatus for supporting breasts in a horizontal position, such as but not limited to during sleep in a side position. The breast support apparatus includes a body segment that is capable of being worn between the breasts of a user to support the breasts. In various embodiments, the body member is substantially trapezoidal in shape, with concave portions on its sides. In some embodiments, the body segment is comprised of an outer core of a resilient material, such as memory foam, with a harder foam inner core for stabilization.

Although specific embodiments have been illustrated and described herein, it will be appreciated by those of ordinary skill in the art that any arrangement that is calculated to achieve the same purpose may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

I claim:

1. A breast support apparatus configured to be disposed between female breasts for preventing wrinkles, said apparatus comprising;

a one-piece body segment having a proximate end, a convexly curved and rounded distal end, a first concave side, a second concave side, and two laterally extending upwardly curved side portions extending sideways to opposite directions from the distal end, wherein said first concave side extends from said proximate end to said first side portion and said second concave side extends from said proximate end to said second side portion such that each side portion is configured to underlie a breast.

2. The apparatus of claim 1, wherein the apparatus is made of memory foam material.

3. The apparatus of claim 1, wherein the apparatus is provided for different breast sizes.

* * * * *